US005355190A

United States Patent [19]

Rosenburgh et al.

[11] Patent Number: 5,355,190

[45] Date of Patent: Oct. 11, 1994

[54] SLOT IMPINGEMENT FOR AN AUTOMATIC TRAY PROCESSOR

[75] Inventors: John H. Rosenburgh, Hilton; David L. Patton, Webster; Joseph A. Manico, Rochester; Ralph L. Piccinino, Jr., Rush, all of N.Y.

[73] Assignee: Eastman Kodak Company, Rochester, N.Y.

[21] Appl. No.: 56,649

[22] Filed: May 3, 1993

[51] Int. Cl.[5] ..... G03D 3/02

[52] U.S. Cl. ..... 354/324; 354/325; 354/331

[58] Field of Search ..... 354/318–324, 354/331, 336; 134/64 P, 64 R, 122 P, 122 R

[56] References Cited

U.S. PATENT DOCUMENTS

| | | | |
|---|---|---|---|
| 2,419,853 | 4/1947 | Pask | 95/94 |
| 2,956,494 | 10/1960 | Tyler et al. | 95/94 |
| 4,187,023 | 2/1980 | Schausberger et al. | 354/321 |
| 4,359,279 | 11/1982 | Popoff | 354/320 |
| 4,947,199 | 8/1990 | Tsunekawa | 354/322 |
| 4,989,028 | 1/1991 | Hall et al. | 354/324 |
| 4,994,840 | 2/1991 | Hall et al. | 354/324 |
| 5,043,756 | 8/1991 | Takabayashi et al. | 354/320 |

*Primary Examiner*—D. Rutledge
*Attorney, Agent, or Firm*—Frank Pincelli

[57] ABSTRACT

A low volume photographic material processing apparatus that utilizes a narrow horizontal processing channel with an upturned entrance and exit to contain processing solution within the channel. The channel is formed by a repeating combination of squeegee pinch rollers and impingement slot nozzles. Photographic processing solution is introduced through the impingement slot nozzles and the squeegee pinch rollers are used to remove the processing solution from the photosensitive material and provide transport of the photosensitive material. Solution level control is achieved by drains positioned below the tops of the upturned sections. The slot nozzles and the pinch rollers work interactively to break down the chemical barrier layer.

18 Claims, 8 Drawing Sheets

SLOT IMPINGEMENT FOR AN AUTOMATIC TRAY PROCESSOR

CROSS REFERENCE TO RELATE APPLICATIONS

Reference is made to commonly assigned copending patent applications: Reference is made to commonly assigned copending patent applications: Ser. No. 08/057,250, filed May 3, 1993, entitled "AUTOMATIC TRAY PROCESSOR" [filed herewith]in the names of John H. Rosenburgh, Joseph A. Manico, David L. Patton and Ralph L. Piccinino, Jr., and Ser. No. 08/056,428, filed May 3, 1993, entitled "MODULAR PROCESSING CHANNEL FOR AN AUTOMATIC TRAY PROCESSOR" in the names of Joseph A. Manico, Ralph L. Piccinino, Jr., David L. Patton and John H. Rosenburgh, and Ser. No. 08/056,477, filed May 3, 1993, entitled "COUNTER CROSS FLOW FOR AN AUTOMATIC TRAY PROCESSOR" in the names of John H. Rosenburgh, Ralph L. Piccinino, Jr., David L. Patton and Joseph A. Manico, and Ser. No. 08/057,131, filed May 3, 1993, entitled "VERTICAL AND HORIZONTAL POSITIONING AND COUPLING OF AUTOMATIC TRAY PROCESSOR CELLS" in the names of David L. Patton, Joseph A. Manico, John H. Rosenburgh and Ralph L. Piccinino, Jr., and Ser. No. 08/056,451, filed May 3, 1993, entitled "TEXTURED SURFACE WITH CANTED CHANNELS FOR AN AUTOMATIC TRAY PROCESSOR" in the names of Ralph L. Piccinino, Jr., John H. Rosenburgh, David L. Patton and Joseph A. Manico, and Ser. No. 08/056,730, filed May 3, 1993, entitled "AUTOMATIC REPLENISHMENT, CALIBRATION AND METERING SYSTEM FOR AN AUTOMATIC TRAY PROCESSOR" in the names of John H. Rosenburgh, Robert L. Horton and David L. Patton and Ser. No. 08/056,457, filed May 3, 1999, "CLOSED SOLUTION RECIRCULATION/SHUT-OFF SYSTEM FOR AN AUTOMATIC TRAY PROCESSOR" in the names of John H. Rosenburgh, Joseph A. Manico, Ralph L. Piccinino, Jr. and David L. Patton, and Ser. No. 08/056,455, filed May 3, 1993, entitled "AUTOMATIC REPLENISHMENT, CALIBRATION AND METERING SYSTEM FOR A PHOTOGRAPHIC PROCESSING APPARATUS in the names of John H. Rosenburgh, Robert L. Horton and David L. Patton.

FIELD OF THE INVENTION

The invention relates to the field of photography, and particularly to a photosensitive material processing apparatus.

Background of the Invention

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the processing solution: cost money to purchase; change in activity and are seasoned by the constituents of the photosensitive material that leach out during the photographic process; and after the chemicals are used the chemicals must be disposed of in an environmentally safe manner. Thus, it is important in all sizes of photofinishing apparatus to reduce the volume of processing solution. The prior art suggest various types of replenishing systems that add or subtract specific chemicals to the processing solution to maintain a consistency of photographic characteristics in the material developed. It is possible to maintain reasonable consistency of photographic characteristics only for a certain period of replenishment. After a processing solution has been used a given number of times, the solution is discarded and a new processing solution is added to the tank.

Activity degradation due to instability of the chemistry, or chemical contamination, after the components of the processing solution are mixed together causes one to discard the processing solution in smaller volume tanks more frequently than larger volume tanks. Some of the steps in the photographic process utilize processing solutions that contain chemicals that are unstable, i.e., they have a short process life. Thus, processing solutions in tanks that contain unstable chemicals are discarded more frequently than processing solutions in tanks that contain stable chemicals.

Problems to Be Solved by the Invention

The prior art used automatic photoprocessing equipment to process photosensitive material- Automatic photoprocessing equipment typically is configured as a sequential arrangement of transport racks submerged in tanks filled with volumes of processing solutions. The shape and configuration of the racks and tanks is inappropriate in certain environments, for instance: offices, homes, computer areas, etc.

The reason for the above is the potential damage to the equipment and the surroundings that may occur from spilled photographic processing solutions and the lack of facilities i.e. running water and sinks to clean the racks and flush out the tanks. Photographic materials may become jammed in the processing equipment- In this situation the rack must be removed from the tank to gain access to the jammed photographic material in order to remove the jammed material. The shape and configuration of the racks and tanks made it difficult to remove a rack from a tank without spilling any processing solution.

The configuration of the rack and the tank is primarily due to the need to constantly provide active processing solution to the photosensitive material. One of the primary functions of a rack and tank processor is to provide the proper agitation of the processing solution. Proper agitation will send fresh processing solution to the surface or surfaces of the photosensitive material, while removing the exhausted processing solution from the photosensitive material.

The prior art suggests that if the volume of the various tanks contained within various sizes of photographic processing apparatus were reduced the same amount of film or photographic paper may be processed, while reducing the volume of processing solution that was used and subsequently discarded. One of the problems in using smaller volume tanks is to provide sufficient agitation of the processing solution.

The prior art also used alternative techniques to remove exhausted processing solution from the surface or surfaces of the photosensitive material and to provide fresh processing solution to the surface or surfaces of the photosensitive material. These techniques include rotating patterned drums, mesh screens, squeegee blades and solution jets etc. Mesh screens and rotating drums work well in removing exhausted processing solution and supplying fresh processing solution. Mesh screens, squeegee blades and drums may damage the delicate surface or surfaces of the photosensitive material with debris that accumulates within the mesh, on the blade, or on the drum surface. An additional problem with the rotating drum is that the rotating drum is large and thus limits the minimum size of the processing equipment. A further problem with a rotating drum is that it can only process one sheet of photosensitive material at a time.

The problem of nonuniform processing of the photosensitive material is exacerbated when the widely spaced non-arrayed solution jets are used in close proximity to the photosensitive material. Solution jets also provide a method for removing and supplying fresh processing solution to and from the surface or surfaces of the photosensitive material.

However, if one used solution jets in the form of jets or holes to distribute fresh processing solution in small volume processing tanks, the photosensitive material would not be uniformly developed. The reason for the above is that when the fresh processing solution was distributed, the fresh processing solution was close to the photosensitive material and did not have space to uniformly spread out across the surfaces of the photosensitive material. If the distance between the nozzles or holes and the surface of the photosensitive material were increased to obtain adequate distribution of the fresh processing solution, one would no longer have a small volume tank.

Slots were not used by the prior art to distribute fresh processing solution in large volume tanks since the processing solution would not travel uniformly across a large volume of solution.

As the photosensitive material passes through the tank, a boundary layer is formed between the surfaces of the photosensitive material and the processing solution. The processing solution moves with the photosensitive material. Thus, the boundary layer between the photosensitive material and the processing solution has to be broken up to enable fresh processing solution to reach the photosensitive material. Rollers were used in large prior art tanks to break up the boundary layer. The roller squeegeed the exhausted processing solution away from the surfaces of the photosensitive material, thus, permitting fresh processing solution to reach the surfaces of the photosensitive material. One would not use rollers in small volume tanks, to break the boundary layer between the photosensitive material and the processing solution, since rollers require additional space and add to the volume of required processing solution.

A further problem with existing processors is that the processor may only process, at a given time, photosensitive material in a roll or cut sheet format. In addition, processors that are configured to process photosensitive material in a cut sheet format, may be limited in their ability to process the photosensitive material, by the minimum or maximum length of the photosensitive material, that may be transported.

Additional rollers are required to transport shorter photosensitive material lengths. The reason for this is that, a portion of the photosensitive material must always be in physical contact with a pair of transporting rollers, or the cut sheet of photosensitive material will fail to move through the entire processor. As the number of required transport rollers increases, the agitation of the processing solution decreases. Even though the rollers remove processing solution and hence, break up the boundary layer, the additional rollers severely impede the flow of fresh processing solution to and exhausted processing solution from the surface of the photosensitive material.

SUMMARY OF THE INVENTION

This invention overcomes the disadvantages of the prior art by providing a low volume photographic material processing apparatus that introduces fresh processing solution uniformly across the surfaces of a photosensitive material. The processing apparatus utilizes a slot nozzle configuration, whose fluid distribution pattern meets or exceeds the width of the photosensitive material. The slot nozzle does not have to be periodically changed or cleaned and is designed in such a manner that an amount of fresh processing solution exits the slot nozzle at a sufficient velocity to disrupt the boundary layer of exhausted processing solution allowing fresh processing solution to reach the surfaces of the photosensitive material. The slot nozzle permits the velocity of the exiting processing solution to be varied by changing the pressure of the solution. Thus, controlling the amount of fresh processing solution reaching the surfaces of the photosensitive material. Hence, the chemical reaction between the photosensitive material and the fresh processing solution reaching the surface of the photosensitive material may be controlled.

Additional slot nozzles may be utilized to control the amount of chemical reaction between the fresh processing solution and the photosensitive material.

The foregoing is accomplished by providing a low volume photographic material processing apparatus that utilizes a narrow horizontal processing channel with an upturned entrance and exit to contain the processing solution within the channel. The channel is formed by a repeating combination of squeegee pinch rollers and impingement slot nozzles. Photographic processing solution is dynamically impinged on the surface of the photosensitive material through one or more impingement slot nozzles and the squeegee pinch rollers are used to remove the processing solution from the photosensitive material and provide transport of the photosensitive material.

Advantageous Effect of the Invention

The above arrangement of solution impingement slot nozzles and squeegee pinch rollers, provide transport of either cut sheet or roll photosensitive material and work interactively to provide fresh processing solution to the photosensitive material while removing exhausted processing solution from the photosensitive material.

The impingement slot nozzles provide an efficient method of transporting the processing solution to the surface or surfaces of the photosensitive material so that very small volumes of processing solution may be used to process the photosensitive material. The slot nozzles supply processing solution to the surface or surfaces of the photosensitive material in such a manner that uniform processing across the surface or surfaces of the photosensitive material is achieved. The above is accomplished, while using a small volume of processing solution without submerging most of the components of the photographic processor in processing solution. Thus, the residual processing solution is not contained in the processing channel. Hence, the residual processing solution may be simultaneously filtered, transported, chemically treated (ion exchange) and temperature controlled outside of the processing channel. Additional processing efficiency may be achieved by the appropriate arrangement of slot nozzles and squeegee pinch rollers.

The foregoing is accomplished by providing an apparatus for processing photosensitive materials, which comprises: a container which contains a channel through which a processing solution flows, the entrance and exit of the channel are upturned to contain processing solution within the channel; means coupled to the channel for transporting the photosensitive material from the channel entrance, through the channel, to the channel exit, the channel and the means are relatively dimensioned so that a small volume for holding processing solution and photosensitive material is formed between the channel and the means;

means for circulating the processing solution through the small volume and said container; and one or more slot nozzles coupled to the circulating means and forming a portion of the channel for controlling the velocity and amount of processing solution that dynamically impinges on the surface of the photosensitive material.

DESCRIPTION OF THE PREFERRED EMBODIMENT

Figure 1:
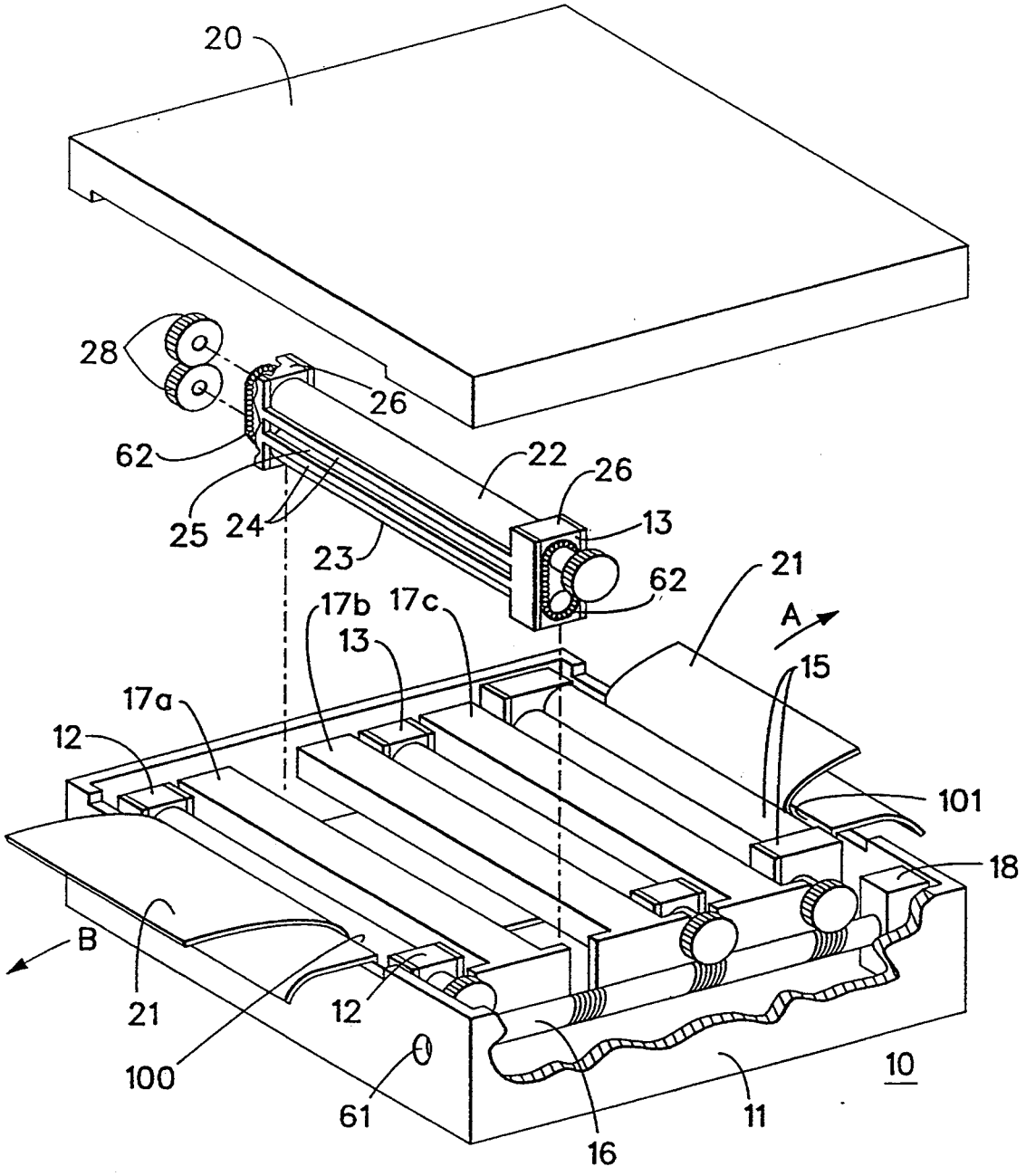
FIG. 1 is a perspective drawing of module 10.

Referring now to the drawings in detail, and more particularly to FIG. 1, the reference character 10 represents a processing module, which may stand alone or be easily combined or adjoined with other processing modules 10 to form a continuous low volume unit for processing photosensitive materials.

Processing module 10 includes: a container 11; an upturned entrance channel 100 (described in the description of FIG. 2); an entry transport roller assembly 12; transport roller assemblies 13; an exit transport roller assembly 15; an upturned exit channel 101 (described in the description of FIG. 2); high impingement slot nozzles 17*a*, 17*b* and 17*c*; a drive 16 and a rotating assembly 18, assembly 18 may be any known means for turning drive 16, i.e., a motor, a gear, a belt, a chain, etc. An access hole 61 is provided in container 11. Hole 61 is utilized for the interconnection of modules 10. Assemblies 12, 13 and 15 are positioned within container 11 in the vicinity of the walls of container 11 and slot nozzles 17*a*, 17*b* and 17*c* are positioned within the vicinity of the walls of container 11. Drive 16 is connected to roller assemblies 12, 13 and 15 and turning assembly 18 and assembly 16 is used to transmit the motion of assembly 18 to assemblies 12, 13 and 15.

Roller assemblies 12, 13, and 15, and slot nozzles 17*a*, 17*b* and 17*c* may be easily inserted into or removed from container 11. Roller assembly 13 includes: a top roller 22; a bottom roller 23; tension springs 62, which holds top roller 22 in compression with respect to bottom roller 23; a bearing bracket 26; and a channel section 24. A narrow channel opening 25 exists within section 24. Opening 25 on the entrance side of section 24 may be the same size and shape as opening 25 on the exit side of section 24. Opening 25 on the entrance side of section 24 may also be relieved, tapered or larger than the exit side of section 24 to accommodate rigidity variations of various types of photosensitive material 21. Channel opening 25 forms a portion of processing channel 25. Rollers 22 and 23 may be drive or driven rollers and rollers 22 and 23 are connected to bracket 26. Rollers 22 and 23 are rotated by intermeshing gears 28.

Photosensitive material 21 is transported in either direction A or direction B automatically through processing channel 25 by roller assemblies 12, 13 and 15. Photosensitive material 21 may be in a cut sheet or roll format or photosensitive material 21 may be simultaneously in a roll and simultaneously in a cut sheet format. Photosensitive material 21 may contain an emulsion on either or both of its surfaces.

When cover 20 is placed on container 11 a light tight enclosure is formed. Thus, module 10 with its associated recirculation system 60, which is described in the description of FIG. 5, will be a stand alone light tight module that is capable of processing photosensitive material, i.e., a monobath. When two or more modules 10 are combined a multi-stage continuous processing unit may be formed. The combination of one or more modules 10 will be more fully set forth in the description of FIG. 6.

Figure 2:
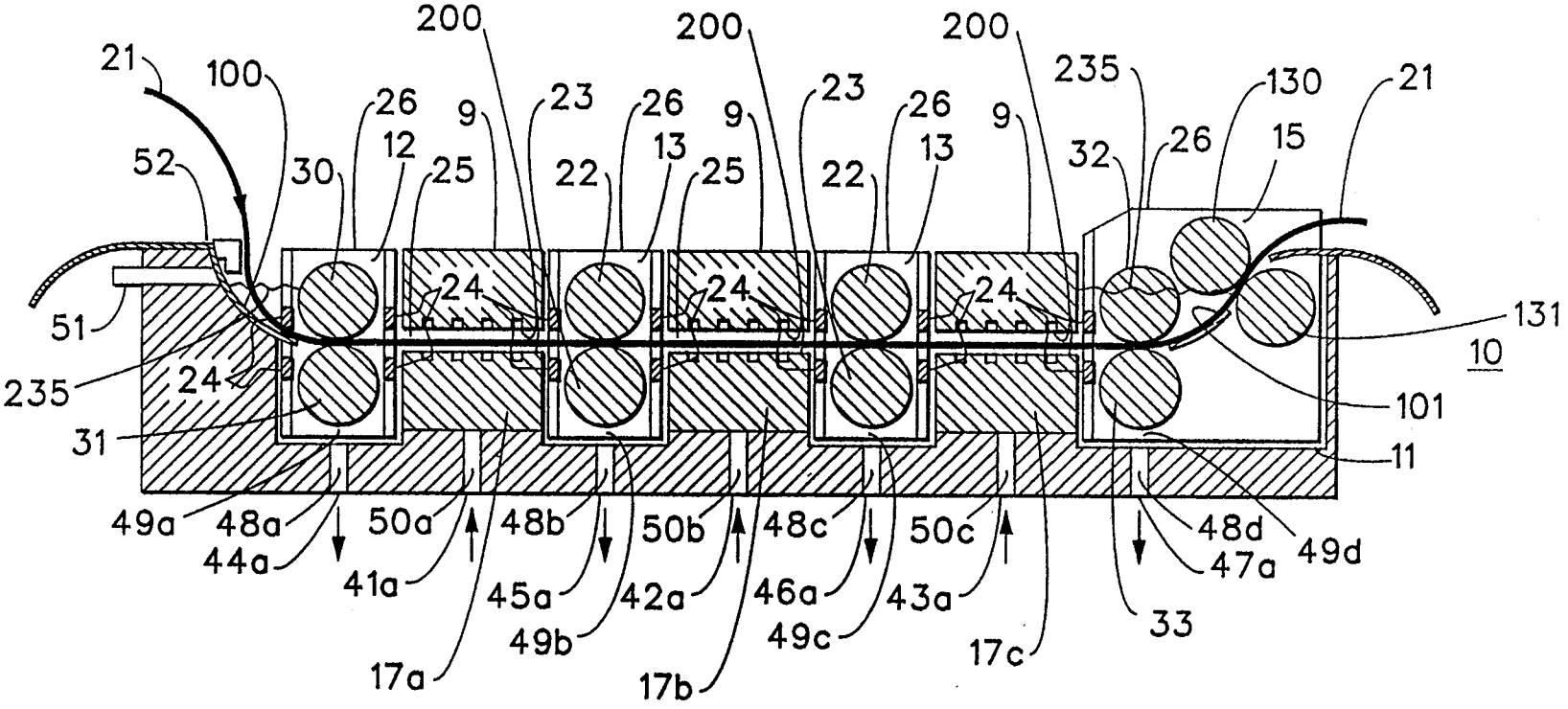
FIG. 2 is a partially cut away drawing of module 10 in which material 21 has an emulsion on one surface and nozzles 17*a*, 17*b* and 17*c* are on the bottom portion of container 11 facing the emulsion surface of material 21.

FIG. 2 is a partially cut away section of module 10 of FIG. 1. Assemblies 12, 13 and 15, nozzles 17*a*, 17*b* and 17*c* and backing plate 9 are designed in a manner to minimize the amount of processing solution that is contained in processing channel 25, vessel 11, recirculation system 60 (FIG. 5) and gaps 49*a*, 49*b*, 49*c* and 49*d*. At the entrance of module 10, an upturned channel 100 forms the entrance to processing channel 25. At the exit of module 10, an upturned channel 101 forms the exit to processing channel 25. Assembly 12 is similar to assembly 13. Assembly 12 includes: a top roller 30; a bottom roller 31; tension springs 62 (not shown) which holds top roller 30 to bottom roller 31; a bearing bracket 26; and a channel section 24. A portion of narrow processing channel 25 is formed by channel section 24. Rollers 30 and 31 may be drive or driven rollers and rollers 30 and 31 are connected to bracket 26. Assembly 15 is similar to assembly 13, except that assembly 15 has an additional two rollers 130 and 131, which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*a*, 17*b* and 17*c* are affixed to container 11. The embodiment shown in FIG. 2 will be used when photosensitive material 21 has an emulsion on one of its surfaces. The emulsion side of material 21 will face slot nozzles 17*a*, 17*b* and 17*c*. Material 21 enters channel 25 between rollers 30 and 31 and moves past backing plate 9 and nozzle 17*a*. Then material 21 moves between rollers 22 and 23 and moves past backing plates 9 and nozzles 17*b* and 17*c*. At this point material 21 will move between rollers 32 and 33, and move between rollers 130 and 131 and exit processing channel 25.

Figure 5:
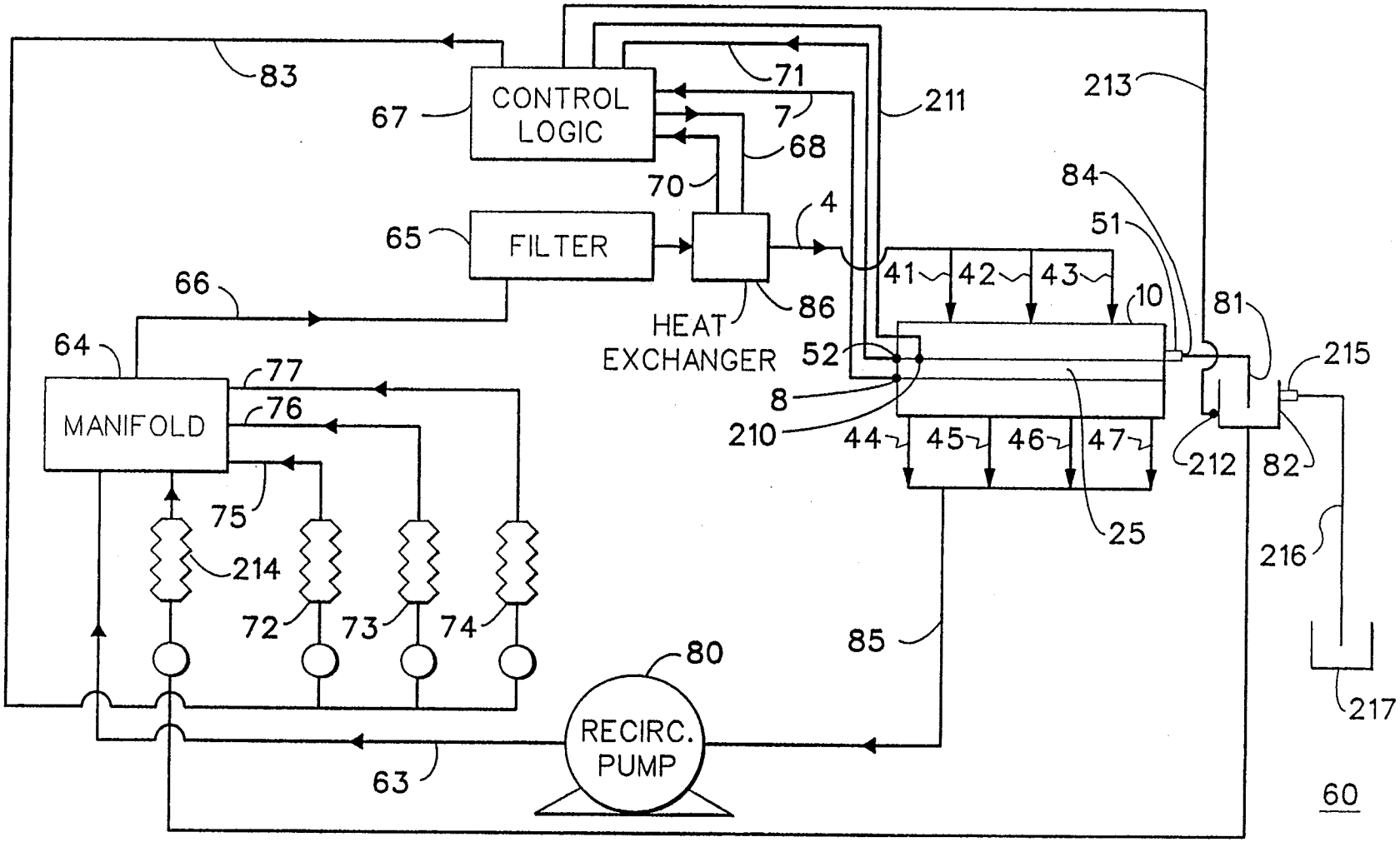
FIG. 5 is a schematic drawing of the processing solution recirculation system of the apparatus of this invention.

Conduit 48*a* connects gap 49*a*, via port 44*a* to recirculation system 60 via port 44 (FIG. 5), which is more fully described in the description of FIG. 5, and conduit 48*b* connects gap 49*b*, via port 45*a* to recirculation system 60 via port 45 (FIG. 5). Conduit 48*c* connects gap 49*c*, via port 46*a* to recirculation system 60 via port 46 (FIG. 5) and conduit 48d connects gap 49*d*, via port 47*a* to recirculation system 60 via port 47 (FIG. 5). Slot nozzle 17*a* is connected to recirculation system 60 via conduit 50*a* and inlet port 41*a* via port 44 (FIG. 5) and slot nozzle 17*b* is connected to recirculation system 60 via conduit 50*b* and inlet port 42*a* via inlet port 42 (FIG. 5). Conduit 50*c* connects nozzle 17*c*, via inlet port 43a to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*a*, 17*b* and 17*c* that faces processing channel 25.

Figure 3:
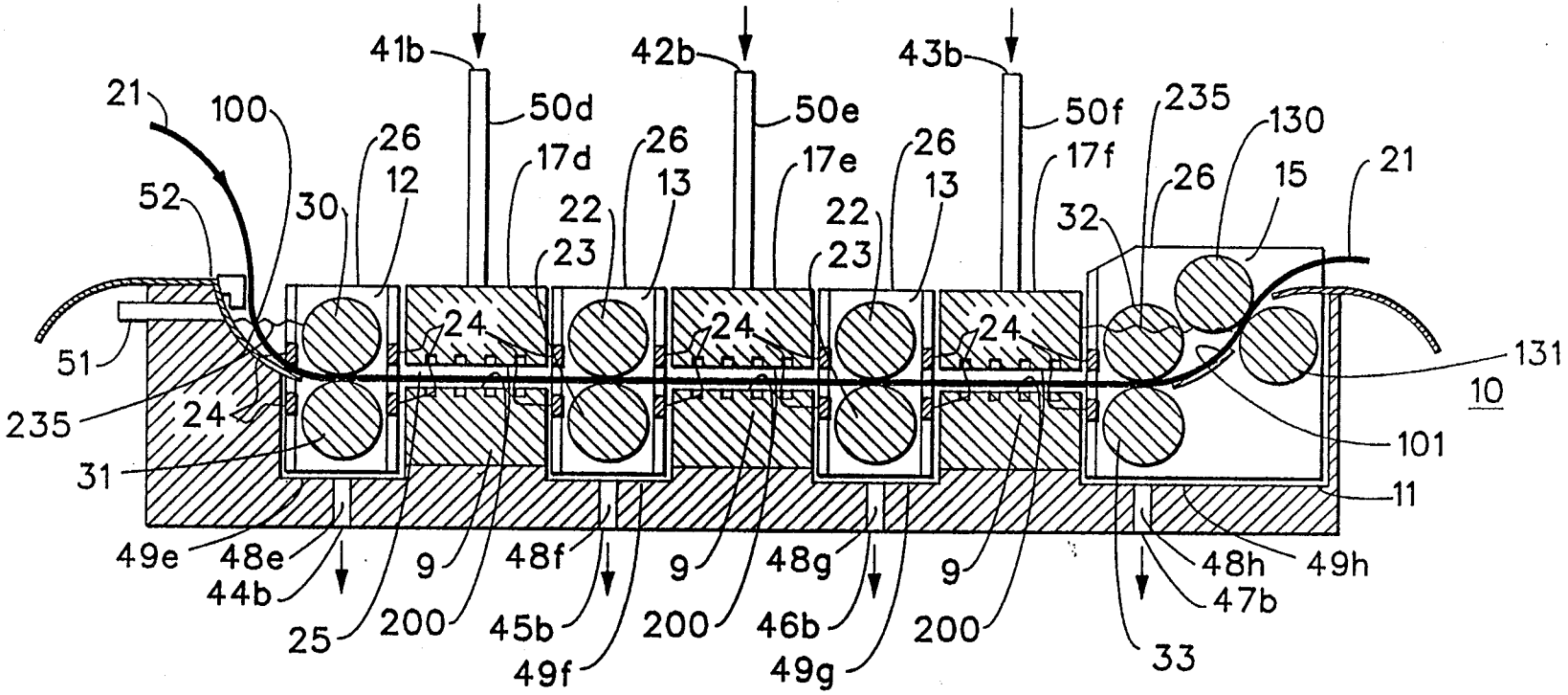
FIG. 3 is a partially cut away drawing of an alternate embodiment of module 10 of FIG. 2 in which material 21 has an emulsion on one surface and nozzles 17*d*, 17*e* and 17*f* are on the top portion of container 11 facing the emulsion surface of material 21.

FIG. 3 is a partially cut away drawing of an alternate embodiment of module 10 of FIG. 2 in which material 21 has an emulsion on one surface and nozzles 17*d*, 17*e* and 17*f* are on the top portion of container 11. Assemblies 12, 13 and 15, nozzles 17*d*, 17*e* and 17*f* and backing plate 9 are designed in a manner to minimize the amount of processing solution that is contained in processing channel 25 and gaps 49*e*, 49*f*, 49*g* and 49*h*. At the entrance of module 10, an upturned channel 100 forms the entrance to processing channel 25. At the exit of module 10, a upturned channel 101 forms the exit to processing channel 25. Assembly 12 is similar to assembly 13. Assembly 12 includes: a top roller 30; a bottom roller 31; tension springs 62 (not shown) which holds top roller 30 in compression with respect to bottom roller 31; a bearing bracket 26; and a channel section 24. A portion of narrow channel opening 25 exists within section 24. Channel section 24 forms a portion of processing channel 25. Rollers 30 and 31 may be drive or driven rollers and rollers 30 and 31 are connected to bracket 26. Assembly 15 is similar to assembly 13, except that assembly 15 has an additional two rollers 130 and 131 which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*d*, 17*e* and 17*f* are affixed to container 11. The embodiment shown in FIG. 3 will be used when photosensitive material 21 has an emulsion on one of its surfaces. The emulsion side of material 21 will face slot nozzles 17*d*, 17*e* and 17*f*. Material 21 enters channel 25 between rollers 30 and 31 and moves past backing plate 9 and nozzle 17*d*. Then material 21 moves between rollers 22 and 23 and moves past backing plates 9 and nozzles 17*e* and 17*f*. At this point material 21 will move between rollers 32 and 33 and move between rollers 130 and 131 and exit processing channel 25.

Conduit 48*e* connects gap 49*e*, via port 44*b* to recirculation system 60 via port 44 (FIG. 5) and conduit 48*f* connects gap 49*f*, via port 45*b* to recirculation system 60 via port 45 (FIG. 5). Conduit 48*g* connects gap 49*g*, via port 46*b* to recirculation system 60 via port 46 (FIG. 5) and conduit 48*h* connects gap 49*h*, via port 47*b* to recirculation system 60 via port 47 (FIG. 5). Slot nozzle 17*d* is connected to recirculation system 60 via conduit 50*d* and inlet port 41*b* via inlet 41 (FIG. 5) and slot nozzle 17*e* is connected to recirculation system 60 via conduit 50*e* and inlet port 42*b* via port 42 (FIG. 5). Conduit 50*f* connects nozzle 17*f*, via inlet port 43*b* to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*d*, 17*e* and 17*f* that faces processing channel 25.

Figure 4:
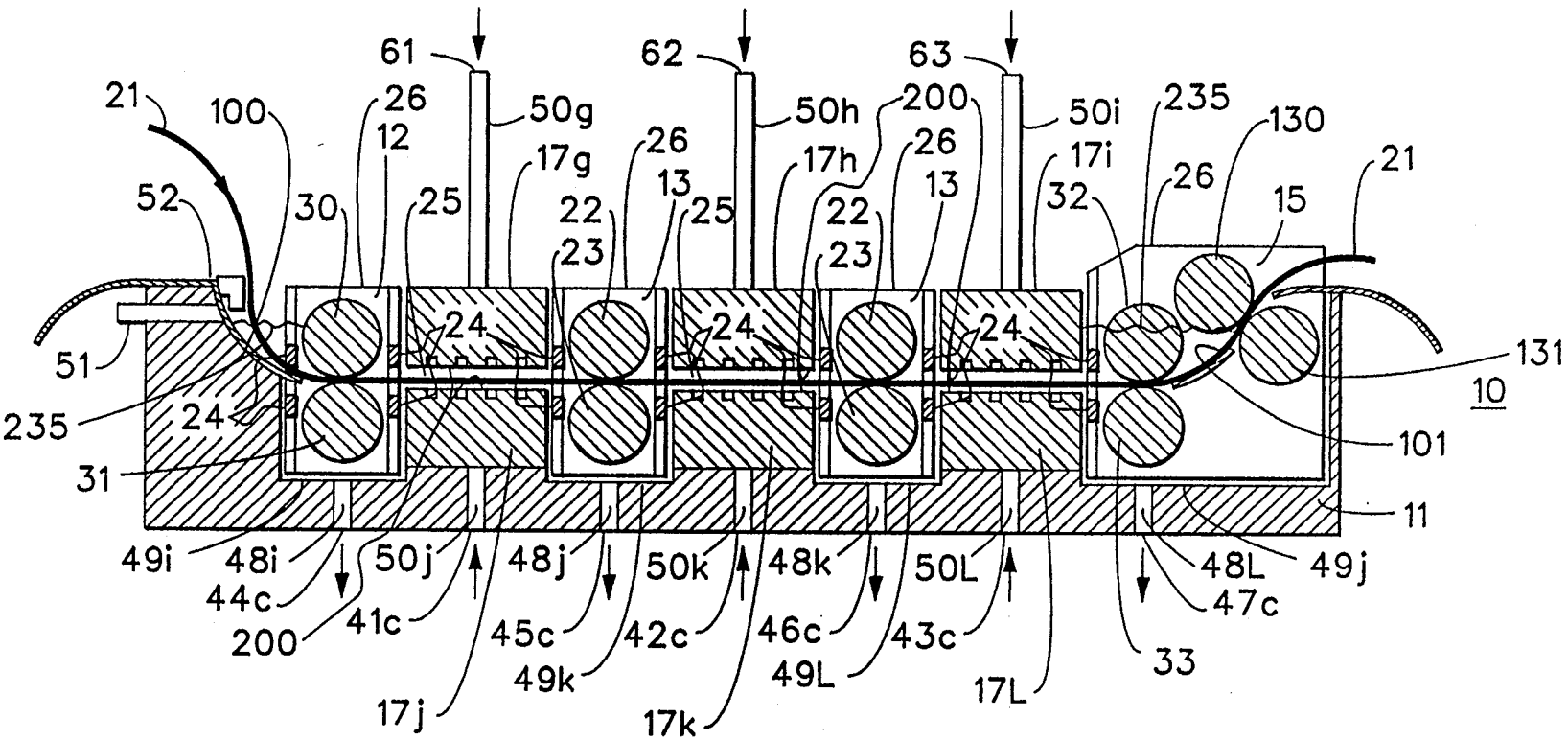
FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17*L* are on the bottom portion of container 11 facing the other emulsion surface of material 21.

FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 lacing one emulsion surface of material 21 and nozzles 17*j*, 17*k*, and 17*L* are on the bottom portion of container 11 facing the other emulsion surface of material 21. Assemblies 12, 13 and 15, nozzles 17g, 17h, 17i, 17j, 17k and 17L are designed in a manner to minimize the amount of processing solution that is contained in processing channel 25 and gaps 49i, 49j, 49k and 49L. At the entrance of module 10, an upturned channel 100 forms the entrance to processing channel 25. At the exit of module 10, an upturned channel 101 forms the exit to processing channel 25. Assembly 12 includes: a top roller 30; a bottom roller 31; tension springs 62 (not shown) which holds top roller 30 in compression with respect to bottom roller 31, a bearing bracket 26; and a channel section 24. A portion of narrow processing channel 25 exists within section 24. Channel section 24 forms a portion of processing channel 25. Rollers 30, 31, 130 and 131 may be drive or driven rollers and rollers 30, 31, 130 and 131 are connected to bracket 26. Assembly 15 is similar to assembly 13, except that assembly 15 has an additional two rollers 130 and 131 which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Slot nozzles 17g, 17h and 17i are affixed to the upper portion of container 11. Slot nozzles 17j, 17k and 17L are affixed to the lower portion of container 11. The embodiment shown in FIG. 4 will be used when photosensitive material 21 has an emulsion on both of its two surfaces. One emulsion side of material 21 will face slot nozzles 17g, 17h and 17i and the other emulsion side of material 21 will face slot nozzles 17j, 17k and 17L. Material 21 enters channel 25 between rollers 30 and 31 and moves past and nozzles 17g and 17j. Then material 21 moves between rollers 22 and 23 and moves past nozzles 17h, 17k, 17i and 17L. At this point material 21 will move between rollers 32 and 33 and move between rollers 130 and 131 and exit processing channel 25.

Conduit 48i connects gap 49i, via port 44c to recirculation system 60 via port 44 (FIG. 5) and conduit 48j connects gap 49k, via port 45c to recirculation system 60 via port 45 (FIG. 5). Conduit 48k connects gap 49L, via port 46c to recirculation system 60 and conduit 48L connects gap 49j, via port 47c to recirculation system 60 via port 47 (FIG. 5). Slot nozzle 17g is connected to recirculation system 60 via conduit 50g via port 41 (FIG. 5). Slot nozzle 17h is connected to recirculation system 60 via conduit 50h and inlet port 62 via port 42 (FIG. 5). Conduit 50i connects nozzle 17i, via inlet port 63 to recirculation system 60 via port 43 (FIG. 5). Slot nozzle 17j is connected to recirculation system 60 via conduit 50j and inlet port 41c via port 41 (FIG. 5) and slot nozzle 17k is connected to recirculation system 60 via conduit 50k and inlet port 42c via port 42 (FIG. 5). Slot nozzle 17L is connected to recirculation system 60 via conduit 50L and inlet port 43c via port 43 (FIG. 5). Sensor 52 is connected to container 11 and sensor 52 is used to maintain a processing solution level 235 relative to conduit 51. Excess processing solution may be removed by overflow conduit 51. Material 21 enters upturned channel entrance 100, then passes through channel section 24 of channel 25 between rollers 30 and 31 and moves past nozzles 17g and 17j. Then material 21 moves between rollers 22 and 23 and moves past nozzles 17h and 17k, 17L and 17i. At this point material 21 will move between rollers 32 and 33 and exit processing channel 25. Conduit 48i connects; gap 49i, via port 44c to recirculation system 60 via port 44 (FIG. 5) and conduit 48j connects gap 49k, via port 45c to recirculation system 60 via port 45 (FIG. 5). Conduit 48k connects gap 49L, via port 46c to recirculation system 60 via port 46 (FIG. 5) and conduit 48L connects gap 49j, via port 47c to recirculation system 60 via port 47 (FIG. 5). Sensor 52 is connected to container 11 and sensor 52 is used to maintain a level of processing solution relative to conduit 51. Excess processing solution may be removed by overflow conduit 51.

Textured surface 200 or 205 is affixed to the surface of slot nozzles 17g, 17h, 17i, 17j, 17k and 17L that face processing channel 25.

FIG. 5 is a schematic drawing of processing solution recirculation system 60 of the apparatus of this invention. Module 10 is designed in a manner to minimize the volume of channel 25. The outlets 44, 45, 46 and 47 of module 10 are connected to recirculating pump 80 via conduit 85. Recirculating pump 80 is connected to manifold 64 via conduit 63 and manifold 64 is coupled to filter 65 via conduit 66. Filter 65 is connected to heat exchanger 86 and heat exchanger 86 is connected to channel 25 via conduit 4. Heat exchanger 86 is also connected to control logic 67 via wire 68. Control logic 67 is connected to heat exchanger 86 via wire 70 and sensor 52 is connected to control logic 67 via wire 71. Metering pumps 72, 73 and 74 are respectively connected to manifold 64 via conduits 75, 76 and 77.

The photographic processing chemicals that comprise the photographic solution are placed in metering pumps 72, 73 and 74. Pumps 72, 73 and 74 are used to place the correct amount of chemicals in manifold 64, when photosensitive material sensor 210 senses that material 21 (FIG. 1) is entering channel 25. Sensor 210 transmits a signal to pumps 72, 73 and 74 via line 211 and control logic 67. Manifold 64 introduces the photographic processing solution into conduit 66.

The photographic processing solution flows into filter 65 via conduit 66. Filter 65 removes contaminants and debris that may be contained in the photographic processing solution. After the photographic processing solution has been filtered, the solution enters heat exchanger 86.

Sensor 52 senses the solution level and sensor 8 senses the temperature of the solution and respectively transmits the solution level and temperature of the solution to control logic 67 via wires 71 and 7. For example, control logic 67 is the series CN 310 solid state temperature controller manufactured by Omega Engineering, Inc. of 1 Omega Drive, Stamford, Conn. 06907. Logic 67 compares the solution temperature sensed by sensor 8 and the temperature that exchanger 86 transmitted to logic 67 via wire 70. Logic 67 will inform exchanger 86 to add or remove heat from the solution. Thus, logic 67 and heat exchanger 86 modify the temperature of the solution and maintain the solution temperature at the desired level.

Sensor 52 senses the solution level in channel 25 and transmits the sensed solution level to control logic 67 via wire 71. Logic 67 compares the solution level sensed by sensor 52 via wire 71 to the solution level set in logic 67. Logic 67 will inform pumps 72, 73 and 74 via wire 83 to add additional solution if the solution level is low. Once the solution level is at the desired set point control logic 67 will inform pumps 72, 73 and 74 to stop adding additional solution.

Any excess solution may either be pumped out of module 10 or removed through level drain overflow 84 via conduit 81 into container 82.

At this point the solution enters module 10 via inlets 41, 42 and 43. When module 10 contains too much solution the excess solution will be removed by overflow conduit 51, drain overflow 84 and conduit 81 and flow into reservoir 82. The solution level of reservoir 82 is monitored by sensor 212. Sensor 212 is connected to control logic 67 via line 213. When sensor 212 senses the presence of solution in reservoir 82, a signal is transmitted to logic 67 via line 213 and logic 67 enables pump 214. Thereupon, pump 214 pumps solution into manifold 64. When sensor 212 does not sense the presence of solution, pump 214 is disabled by the signal transmitted via line 213 and logic 67. When solution in reservoir 82 reaches overflow 215 the solution will be transmitted through conduit 216 into reservoir 217. The remaining solution will circulate through channel 25 and reach outlet lines 44, 45, 46 and 47. Thereupon, the solution will pass from outlet lines 44, 45, 46 and 47 to conduit line 85 to recirculation pump 80. The photographic solution contained in the apparatus of this invention, when exposed to the photosensitive material, will reach a seasoned state more rapidly than prior art systems, because the volume of the photographic processing solution is less.

Figure 6:
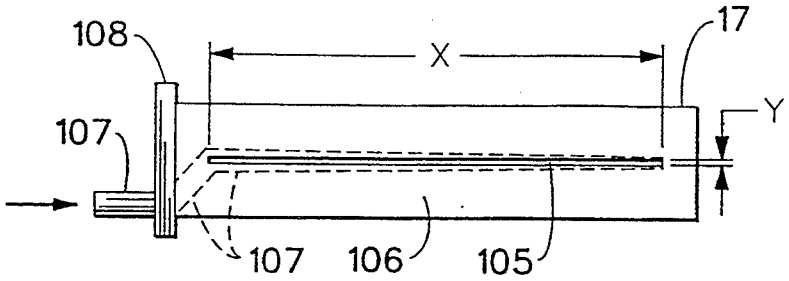
FIG. 6 is a perspective drawing of a slot nozzle.

FIG. 6 is a perspective drawing of slot nozzle 17. Slot 105 runs across surface 106 of slot nozzle 17. Conduit 107 connects slot 105 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 107 with an ever increasing velocity providing a uniform flow of processing solution out of the entire length of slot 105. The width X of the processing solution exiting slot 105 is adequate to cover the width of photosensitive material 21. The depth or thickness y of slot 105 is such that y/x (100) is less than 1.

Figure 7:
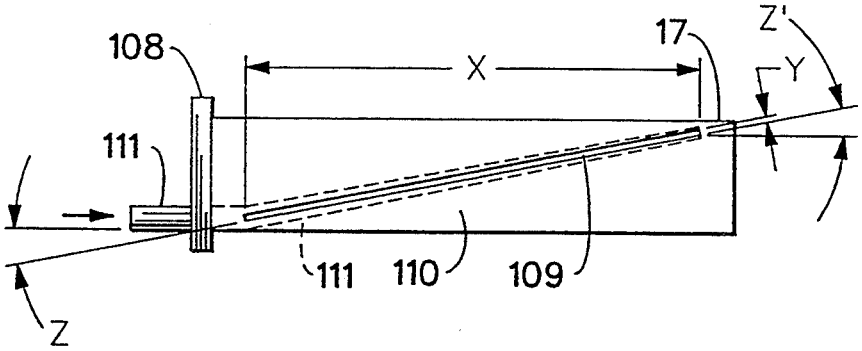
FIG. 7 is a perspective drawing of an alternate embodiment of a slot nozzle.

FIG. 7 is a perspective drawing of an alternate embodiment of slot nozzle 17. Slot 109 runs across surface 106 of slot nozzle 17. The orientation of slot 109 is determined by angles Z and Z'. Angles Z and Z' are between 0 and plus or minus 89 degrees. Conduit 111 connects slot 109 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 111 with an ever increasing velocity providing a uniform flow of processing solution out of the entire length of slot 109. The width X of the processing solution exiting slot 109 is adequate to cover the width of photosensitive material 21. The depth or thickness y of slot 109 is such that y/x (100) is less than 1.

Figure 8:
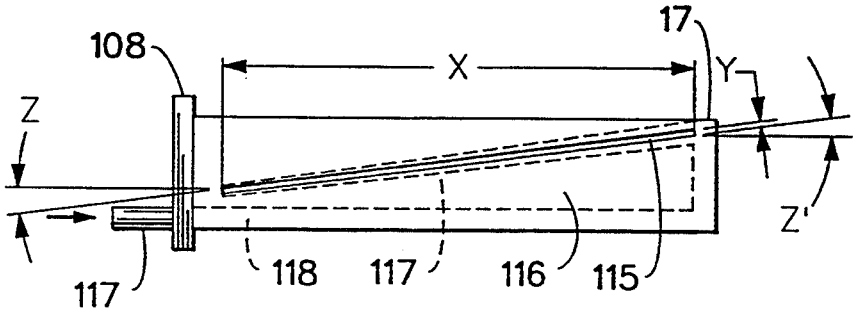
FIG. 8 is a perspective drawing of an alternate embodiment of a slot nozzle.

FIG. 8 is a perspective drawing of an alternate embodiment of slot nozzle 17. Slot 115 runs across surface 116 of slot nozzle 17. The orientation of slot 115 is determined by angles Z and Z' Angles Z and Z' are between 0 and plus or minus 89 degrees. Conduit 118 is connected to inlets 41*a*, 41*b*, 41*c*, 42*a*, 42*b*, 42*c*, 43*a*, 43*b*, 43*c*, 61, 62 and 63 and conduit 118 is connected to conduit 117. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down conduit 118. Processing solution will then enter narrowing conduit 117 and have an ever increasing velocity as the processing solution proceeds down conduit 117. This will provide a uniform flow of processing solution out of the entire length of slot 115. The width X of the processing solution exiting slot 115 is adequate to cover the width of photosensitive material 21. The depth or thickness y of slot 115 is such that y/x (100) is less than 1.

Figure 9:
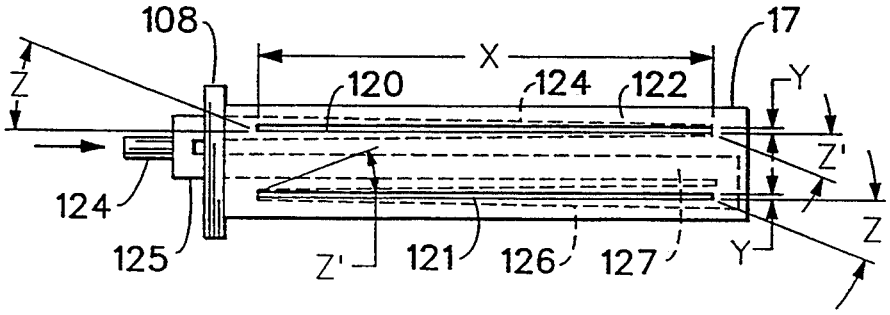
FIG. 9 is a perspective drawing of an alternate embodiment of a slot nozzle.

FIG. 9 is a perspective drawing of an alternate embodiment of slot nozzle 17. Slots 120 and 121 run across surface 122 of slot nozzle 17. The orientation of slots 120 and 121 is determined by angles Z and Z'. Angles Z and Z' are between 0 and 89 degrees. Narrowing conduit 124 is connected to slot 120 and conduit 124 is connected to manifold 125. Manifold 125 is connected to inlets 41*a*, 41*b*, 41*c*, 42*a*, 42*b*, 42*c*, 43*a*, 43*b*, 43*c*, 61, 62 and 63. Conduit 127 connects manifold 125 to narrowing conduit 126. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed through manifold 125, and simultaneously proceed through narrowing conduit 124 and conduit 127. The processing solution travelling in conduit 124 will have an ever increasing velocity as the processing solution proceeds down conduit 124. This will provide a uniform flow of processing solution out of the entire length of slot 120. The processing solution travelling in conduit 127 will proceed through conduit 126 and have an ever increasing velocity as the processing solution proceeds down conduit 126. This will provide a uniform flow of processing solution out of the entire length of slot 121. The width X of the processing solution exiting slots 120 and 121 is adequate to cover the width of photosensitive material 21. The depth or thickness y of slots 120 and 121 is such that y/x (100) is less than 1.

Figure 10:
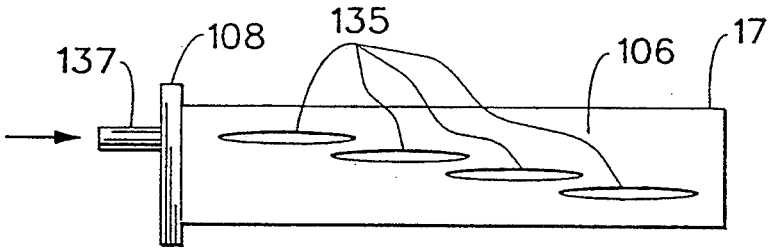
FIG. 10 is a perspective drawing of an alternate embodiment of a slot nozzle.

FIG. 10 is a perspective drawing of an alternate embodiment of slot nozzle 17. Slots 135 run across surface 106 of slot nozzle 17. Conduit 137 connects slots 135 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 137 or straight conduit 137 to provide a uniform flow of processing solution out of the entire length of slots 135.

Figure 11:
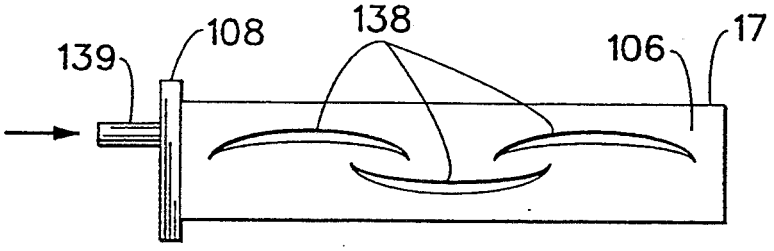
FIG. 11 is a perspective drawing of an alternate embodiment of a slot nozzle.

FIG. 11 is a perspective drawing of an alternate embodiment of slot nozzle 17. Slots 138 run across surface 106 of slot nozzle 17. Conduit 137 connects slots 135 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 139 or straight conduit 139 to provide a uniform flow of processing solution out of the entire length of slots 138.

Figure 12:
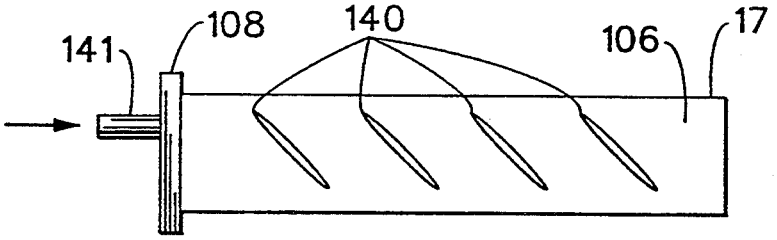
FIG. 12 is a perspective drawing of an alternate embodiment of a slot nozzle.

FIG. 12 is a perspective drawing of an alternate embodiment of slot nozzle 17. Slots 140 run across surface 106 of slot nozzle 17. Conduit 141 connects slots 140 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 141 or straight conduit 141 to provide a uniform flow of processing solution out of the entire length of slots 140.

Figure 13:
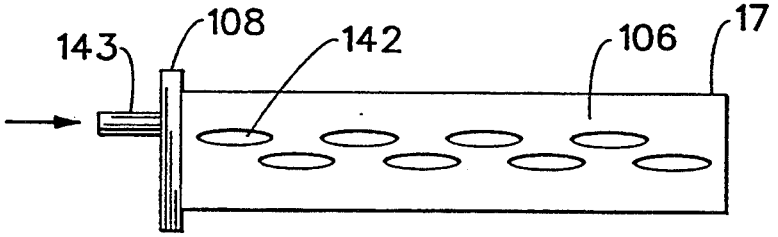
FIG. 13 is a perspective drawing of an alternate embodiment of a slot nozzle.

FIG. 13 is a perspective drawing of an alternate embodiment of slot nozzle 17. Slots 142 run across surface 106 of slot nozzle 17. Conduit 143 connects slots 142 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 143 or straight conduit 143 to provide a uniform flow of processing solution out of the entire length of slots 142.

Figure 14:
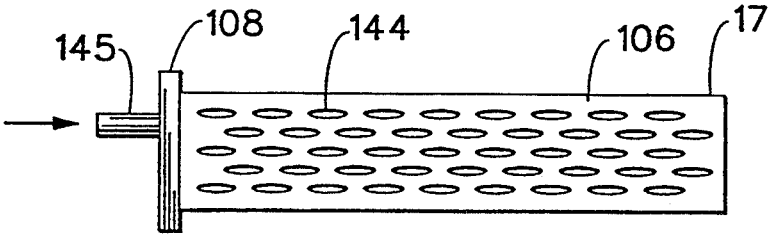
FIG. 14 is a perspective drawing of an alternate embodiment of a slot nozzle.

FIG. 14 is a perspective drawing of an alternate embodiment of slot nozzle 17. Slots 144 run across surface 106 of slot nozzle 17. Conduit 145 connects slots 144 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 145 or straight conduit 145 to provide a uniform flow of processing solution out of the entire length of slots 144.

Figure 15:
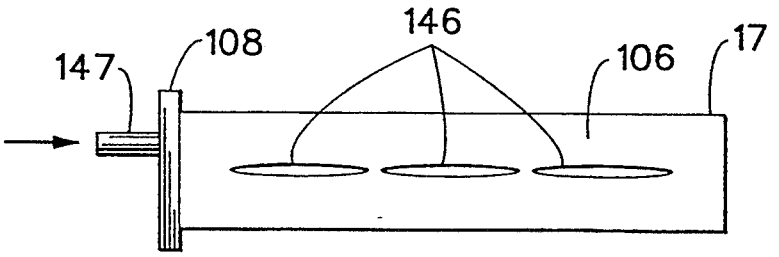
FIG. 15 is a perspective drawing of an alternate embodiment of a slot nozzle.

FIG. 15 is a perspective drawing of an alternate embodiment of slot nozzle 17. Slots 146 run across surface 106 of slot nozzle 17. Conduit 147 connects slots 146 to inlets 41*a*, 41*b*, 41*c*, 42*a*, 42*b*, 42*c*, 43*a*, 43*b*, 43*c*, 61, 62 and 63. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 147 or straight conduit 147 to provide a uniform flow of processing solution out of the entire length of slots 146.

Figure 16:
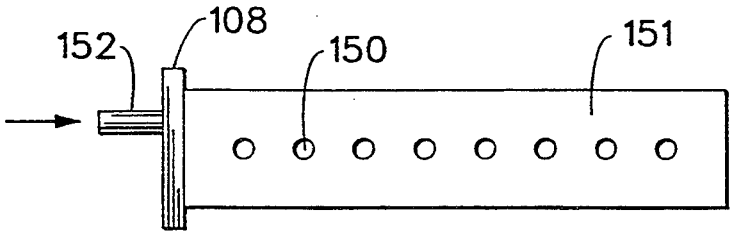
FIG. 16 is a perspective drawing of an alternate embodiment of a slot nozzle.

FIG. 16 is a perspective drawing of an alternate embodiment of slot nozzle 17. Openings 150 run across surface 151 of slot nozzle 17. Conduit 152 connects openings 150 to inlets 41*a*, 41*b*, 41*c*, 42*a*, 42*b*, 42*c*, 43*a*, 43*b*, 43*c*, 61, 62 and 63. The space between openings 150 is one half of the diameter of openings 150 or less. Flange 108 of nozzle 17 is attached to container 11 by any known conventional means which will prevent the leaking of processing solution from container 11, e.g., gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 152 or straight conduit 152 to provide a uniform flow of processing solution out of the entire length of openings 150.

Figure 17:
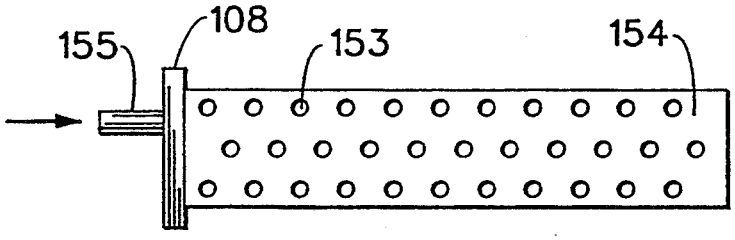
FIG. 17 is a perspective drawing of an alternate embodiment of a slot nozzle.

FIG. 17 is a perspective drawing of an alternate embodiment of slot nozzle 17. Openings 153 run across surface 154 of slot nozzle 17. Conduit 155 connects openings 153 to inlets 41*a*, 41*b*, 41*c*, 42*a*, 42*b*, 42*c*, 43*a*, 43*b*, 43*c*, 61, 62 and 63. The space between openings 153 is one half of the diameter of openings 153 or less. Flange 108 of nozzle 17 is attached to container 11 by any known conventional means which will prevent the leaking of processing solution from container 11, e.g. gaskets, screws etc. Processing solution will enter inlet 41*a*, 41*b*, 41*c*, 42*a*, 42*b*, 42*c*, 43*a*, 43*b*, 43*c*, 61, 62 and 63 proceed down narrowing conduit 155 or straight conduit 155 to provide a uniform flow of processing solution out of the entire length of openings 153.

It will be obvious to one skilled in the art that conduits 107, 111, 117, 124, 137, 141, 143, 145, 147, 152 and 155 of FIGS. 6–15 may be positioned on any side of nozzle 17 and flange 108 of FIGS. 6–15 may be placed on either side of nozzle 17.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

Parts List:

4 conduit
7 wire
8 sensor
9 backing plate
10 processing module
11 container
12 transport roller assembly
13 transport roller assembly
15 transport roller assembly
16 drive
17 nozzle
17*a–l nozzles*
18 rotating assembly
20 cover
21 photosensitive material
22 roller
23 roller
24 channel section
25 channel
26 bearing bracket
28 intermeshing gears
30 roller
31 roller
32 roller
33 roller
41 port
41*a–c* inlet port
42 port
42*a–c* inlet port
43 port
43*a–c* inlet port,
44 port
44*a–c* port
45 port
45*a–c* port
46 port
6*a–c* port
7 port
7*a–c* port
8*a–l* conduit
9*a–l* gap
50*a–l* conduit
51 overflow conduit
52 sensor

60 recirculation system
61 access hole
62 tension springs
63 conduit
64 manifold
65 filter
66 conduit
67 control logic
wire
wire
wire
72 metering pump
73 metering pump
74 metering pump
75 conduit
76 conduit
77 conduit
80 recirculating pump
81 conduit
82 container
83 wire
84 drain overflow
85 conduit
86 heat exchanger
100 entrance channel
101 exit channel
105 slot
107 conduit
108 flange
109 slot
110 surface
111 conduit
115 slot
116 surface
117 conduit
118 conduit
120 slot
121 slot
122 surface
124 conduit
125 manifold
126 conduit
127 conduit
130 roller
131 roller
135 slots
137 conduit
138 slots
139 conduit
140 slots
141 conduit
142 slots
143 conduit
144 slots
145 conduit
146 slots
147 conduit
150 openings
151 surface
152 conduit
153 openings
154 surface
155 conduit
200 textured surface
205 textured surface
210 sensor
211 line
212 sensor
213 line
214 pump
215 overflow
216 conduit
reservoir
235 solution level

What is claimed is:

1. An apparatus for processing photosensitive materials, said apparatus comprising:

a processing module comprising a container, at least one processing assembly placed in said container and at least one transport assembly disposed adjacent said at least one processing assembly, said at least one processing assembly and said at least one transport assembly forming a substantially continuous channel through which a processing solution flows, said at least one processing assembly and said at least one transport assembly substantially filling said container and being relatively dimensioned so that a small volume is provided for holding and moving processing solution and photosensitive material through said processing module, at least one discharge opening is provided in said at least one transport assembly or said at least one processing assembly for introducing processing solution to said channel; and means for circulating the processing solution from said small volume provided in said module directly to said at least one slot nozzle.

2. The apparatus claimed in claim 1 wherein the width of said slot nozzle is such that the processing solution exiting said slot nozzle is wider than the width of the photosensitive material.

3. The apparatus claimed in claim 1, wherein the ratio of the length to the width of slot nozzle is such that the processing solution will rapidly and uniformly exit said slot nozzle.

4. The apparatus claimed in claim 1, further including: a tapered conduit connected to said slot nozzle and said circulating means so that a uniform flow of processing solution is achieved across said slot nozzle.

5. The apparatus claimed in claim 1 wherein the slot of said slot nozzle is perpendicular to the direction of travel of the photosensitive material.

6. The apparatus claimed in claim 1, wherein the slot of said slot nozzle is skewed between 0 degrees and 89 degrees to the direction of travel of the photosensitive material to prevent the leading edge of the photosensitive material from being caught in the slot of said slot nozzle.

7. The-apparatus claimed in claim 1, wherein one or more slots are contained in one slot nozzle.

8. The apparatus claimed in claim 7, wherein said one or more slots are openings.

9. The apparatus claimed in claim 7, wherein said slots are skewed between 0 degrees and 89 degrees to the direction of travel of the photosensitive material to prevent the leading edge of the photosensitive material from being caught in the slot of said slot nozzle.

10. The apparatus claimed in claim 1, wherein said circulation means comprises:

a pump for recirculating the processing solution;

conduits connected to said pump, said container and said channel for transporting the processing solution; and a filter connected to said conduit for removing contaminants from the processing solution, wherein the processing solution volume contained in said pump, said conduits and said filter does not exceed the small volume for holding processing solution.

11. The apparatus claimed in claim 10, further including a heat exchanger that rapidly regulates the temperature of the processing solution.

12. The apparatus claimed in claim 10, further including:

a plurality of metering pumps for metering specified amounts of chemicals; and a manifold coupled to said conduit and said metering pumps for dispensing additional processing solution to the small volume.

13. The apparatus claimed in claim 12, wherein said containers have an overflow conduit coupled to a reservoir to maintain a consistent processing solution level.

14. The apparatus claimed in claim 1, wherein said transporting means comprises:

a plurality of rollers for moving the photosensitive material through the small volume to provide additional agitation of the processing solution.

15. The apparatus claimed in claim 14, wherein said rollers are sized to displace a large or maximum amount of processing solution.

16. An apparatus for processing photosensitive materials, said apparatus comprising:

a processing module comprising a container and at least one processing assembly placed in said container, said at least one processing assembly forming a channel through which a processing solution flows, said channel having an entrance and an exit and at least one discharge opening is provided in said at least one processing assembly for introducing processing solution to said channel;

transport means for transporting the photosensitive material from the channel entrance through said channel to the channel exit, said transport means being disposed adjacent said at least one processing assembly and forming a portion of said channel, said container, said transport means and said at least one processing assembly are relatively dimensioned so that a small volume is provided for holding and moving processing solution and photosensitive material through said processing module; and means for circulating the processing solution through the small volume provided in said processing module.

17. An apparatus for processing photosensitive materials, said apparatus comprising:

a processing module comprising a container, at least one processing assembly placed in said container and at least one transport assembly disposed adjacent said at least one processing assembly, said at least one processing assembly and said at least one transport assembly forming a substantially continuous channel through which a processing solution flows, said at least one processing assembly and said at least one transport assembly substantially filling said container and being relatively dimensioned so that a small volume is provided for holding and moving processing solution and photosensitive material through said processing module, wherein said at least one transport assembly is provided with at least one discharge opening for introducing processing solution to said channel; and means for circulating the processing solution through the small volume provided in said module.

18. An apparatus for processing photosensitive materials, said apparatus comprising:

a processing module comprising a container and at least one processing assembly placed in said container, said container and said at least one processing assembly forming a channel through which a processing solution flows, said channel having an entrance and an exit, said at least one processing assembly having a discharge opening for delivering processing solution to said channel, at least one discharge opening is provided in said at least one processing assembly for introducing processing solution to said channel, said at least one processing assembly and container are relatively dimensioned so that a small volume is provided for holding and moving processing solution and photosensitive material through said processing module; and means for circulating the processing solution directly from said small volume provided in said processing module to said discharge opening.

* * * * *

UNITED STATES PATENT AND TRADEMARK OFFICE

CERTIFICATE OF CORRECTION

PATENT NO. : 5,355,190
DATED : October 11, 1994
INVENTOR(S) : Rosenburgh et al

It is certified that error appears in the above-indentified patent and that said Letters Patent is hereby corrected as shown below:

Column 1, line 38, delete "1999" and insert --1993 --.

Signed and Sealed this

Eighteenth Day of July, 1995

*Attest:*

Bruce Lehman

BRUCE LEHMAN

*Attesting Officer*

*Commissioner of Patents and Trademarks*